United States Patent [19]

Seidl

[11] Patent Number: 4,471,726

[45] Date of Patent: Sep. 18, 1984

[54] CYLINDER HEAD FOR LIQUID-COOLED MULTICYLINDER INTERNAL COMBUSTION ENGINES

[75] Inventor: Jiri Seidl, Munich, Fed. Rep. of Germany

[73] Assignee: Bayerische Motoren Werke A.G., Fed. Rep. of Germany

[21] Appl. No.: 510,218

[22] Filed: Jul. 1, 1983

[30] Foreign Application Priority Data

Jul. 3, 1982 [DE] Fed. Rep. of Germany ..... 3224945

[51] Int. Cl.[3] ..... F01P 3/02

[52] U.S. Cl. ..... 123/41.82 R; 123/41.76

[58] Field of Search ..... 123/41.82 R, 41.82 A, 123/41.76, 41.77, 41.72

[56] References Cited

U.S. PATENT DOCUMENTS

| | | | |
|---|---|---|---|
| 3,468,295 | 9/1969 | Castarede | 123/41.74 |
| 4,147,140 | 4/1979 | Mansfield | 123/41.82 R |

FOREIGN PATENT DOCUMENTS

| | | |
|---|---|---|
| 874847 | 5/1950 | Fed. Rep. of Germany . |
| 1801765 | 10/1968 | Fed. Rep. of Germany . |
| 2113840 | 10/1971 | Fed. Rep. of Germany . |
| 2756006 | 7/1978 | Fed. Rep. of Germany . |
| 2839199 | 3/1980 | Fed. Rep. of Germany . |
| 3123538 | 3/1982 | Fed. Rep. of Germany . |

*Primary Examiner*—William A. Cuchlinski, Jr.
*Attorney, Agent, or Firm*—Craig & Burns

[57] ABSTRACT

A cylinder head for water-cooled multicylinder pressure die-cast formed internal combustion engines comprises series-arranged combustion chambers. A longitudinal duct is arranged at a spacing essentially above the combustion chambers, and niche-like water spaces are all integrally formed toward the dividing plane between the cylinder head and the cylinder block, and are arranged substantially all around the combustion chambers. Connecting ducts emanate from the water spaces and terminate in the longitudinal duct.

2 Claims, 2 Drawing Figures

CYLINDER HEAD FOR LIQUID-COOLED MULTICYLINDER INTERNAL COMBUSTION ENGINES

BACKGROUND OF THE INVENTION

The present invention relates to a cylinder head for a liquid-cooled multicylinder internal combustion engine of the type having series-arranged combustion chambers with at least one longitudinal duct arranged in parallel to the series of combustion chambers and at a spacing from the dividing plane of the cylinder head.

In a conventional cylinder head of this type, as in, for example, DE-A (German Auslegeschrift) No. 2,839,199, the longitudinal duct extends beside the series of combustion chambers closely above the dividing plane of the cylinder head toward the cylinder block. The connecting ducts lie in parallel to this dividing plane and obliquely to the row of combustion chambers as well as to the longitudinal duct. All of the connecting ducts are drilled from an outer side of the cylinder head and sealed at that location by means of closure lids. This construction is suitable exclusively for parallel-suspended valve arrangements because the connecting ducts, in parallel to the dividing plane, do not provide a controlled cooling of the hottest places of the cylinder head in a V-shaped valve arrangement.

DE-A (German Auslegeschrift) No. 2,756,006 discloses a cylinder head having water spaces open toward the cylinder head gasket side and having the form of an annular section, serving as a longitudinal duct, and with an additional, high-level-positioned longitudinal duct in parallel thereto. However, this cylinder head has no connecting ducts between the water spaces and the longitudinal duct and, therefore, lacks the controlled cooling action in their zone. Additionally, the cooling water is conducted essentially only longitudinally through the cylinder head so that local temperature peaks can occur.

SUMMARY OF THE INVENTION

It is an object of the present invention to provide a cylinder head of conventional material having the longitudinal duct and the connecting ducts arranged so that a controlled cooling of the cylinder head hot spots can be achieved in all conventional types of cylinder head structures.

Another object of the present invention is to provide a cylinder head in which a configuration of the longitudinal duct and of the connecting ducts can be obtained directly by drilling or die-casting without additional sealing measures.

In order to attain these objects, a cylinder head for liquid-cooled multicylinder internal combustion engines producible by the pressure die-casting method is provided having the longitudinal duct located with respect to the dividing plane, beyond the combustion chambers, as well as in parallel and in close adjacency to a row of valve bushings and connecting ducts which are arranged at an angle to the dividing plane and extend linearly from the water spaces to the longitudinal ducts as either bores or die-casting grooves. Due to this advantageous arrangement, direct cooling action at the hottest cylinder head zones is provided by the longitudinal duct and by the connecting ducts. Advantageously, because the straight-line connecting ducts emanate directly from the niche-like water spaces, no plugs or closure lids are required, so that a simple and economical manufacture is ensured.

A further object of the present invention is to provide a cylinder head having the inlet and outlet valves disposed in a V-shaped suspension arranged offset in the longitudinal extension of the cylinder head. This advantageous arrangement effects the controlled cooling of the thermally highly stressed locations of the cylinder head, especially the surroundings of the outlet ducts, the respective zones between the outlet ducts and the spark plug, as well as the combustion chamber walls, by means of a regulated longitudinal and transverse flow through the longitudinal duct and the connecting ducts. Furthermore, the oil temperature in the cylinder head is kept at a low level by the efficient cooling of this cylinder head.

BRIEF DESCRIPTION OF THE DRAWINGS

These and other objects, features, and advantages of the present invention will become more apparent from the following description when taken in connection with the accompanying drawings which show, for the purposes of illustration only, one embodiment in accordance with the present invention, and wherein.

DESCRIPTION OF THE PREFERRED EMBODIMENT

Figure 1:
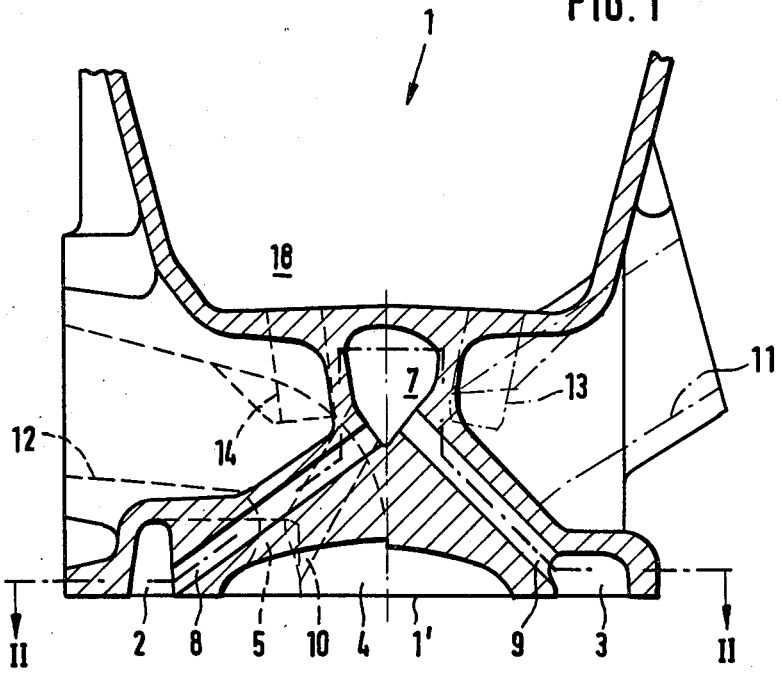
FIG. 1 is a section taken along line I—I of FIG. 2 of a pressure die-cast cylinder head for water-cooled internal combustion engines.
Figure 2:
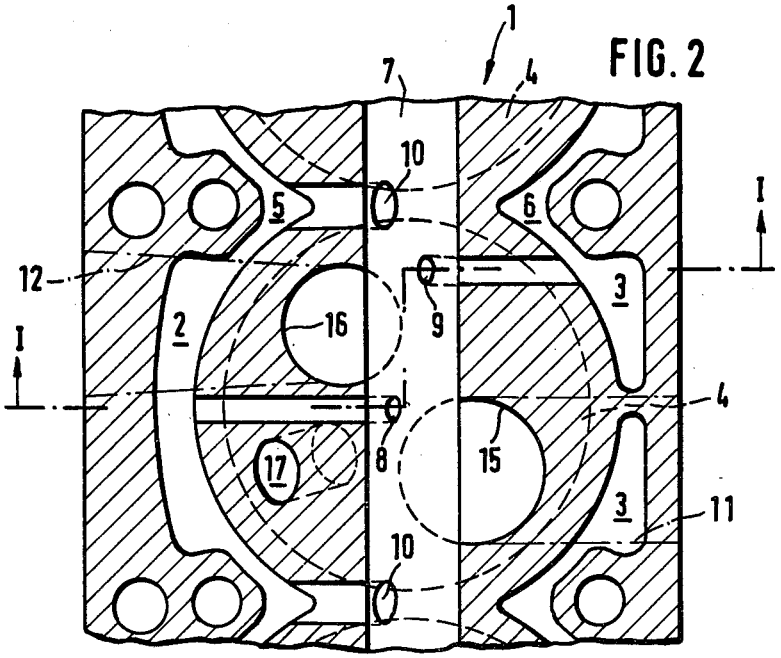
FIG. 2 is a section taken along line II—II of FIG. 1.

A pressure die-cast cylinder head 1 for water-cooled internal combustion engines comprises several niche-like water spaces 2 and 3. The water spaces 2 and 3 can be formed toward the dividing plane 1' between the cylinder head 1 and the cylinder block, not shown, and are arranged around the adjacent combustion chambers 4. The water spaces 2 and 3 are located toward the outsides of the cylinder head 1. They exhibit sections 5 and 6, which extend between the two adjacent combustion chambers 4 toward each other. Above the combustion chambers 4, at a spacing therefrom, a longitudinal duct 7 is disposed. Connecting ducts 8, 9, and 10 extend from the water spaces 2 and 3 and from section 5 of the water space 2 toward the longitudinal duct 7. The connecting ducts 8, 9, and 10 are arranged obliquely to the dividing plane 1'. The connecting ducts 8, 9, and 10 are produced by drilling from either water spaces 2 and 3 or from section 5 of the water space 2. It is also possible to form these connecting ducts 8, 9, and 10 by die-casting grooves. The longitudinal duct 7 can be formed toward the end faces (not shown) of the cylinder head 1. Plugs and other seals are unnecessary, since the connecting ducts 8, 9, and 10 emanate directly from either the water spaces 2 and 3 or from section 5 of water space 2.

The cylinder head 1 comprises a laterally terminating inlet duct 11 and a laterally terminating outlet duct 12. The valves 13 and 14, of which only the valve bushings (valve stem guides) are shown, are disposed in a suspended, offset, and mutually V-shaped fashion. The inlet valve seat 15 and the outlet valve seat 16 are arranged correspondingly offset with respect to each other. A bore 17 for a spark plug (not shown) is arranged opposite to the inlet valve seat 15 so that the bore 17 lies on the same side as the outlet duct 12. The connecting ducts 8 and 10 are located on both sides of the outlet valve seat 16 and of the outlet duct 12, respectively. Thus, the connecting duct 8 lies between the outlet duct 12 and the bore 17 for the spark plug. The connecting duct 9 is arranged substantially in opposition to the outlet duct 12. The longitudinal duct 7 lies between the valve bushings 13 and 14. The angle of inclination (not shown) of the connecting ducts 8, 9, and 10 with respect to the dividing plane 1' is generally between 30° and 60°.

Because of the aforedescribed arrangement, a cylinder head 1 is obtained having a low operating weight, because it has only a small water content. Due to the small amount of water therein, a satisfactory throughflow and cooling of the cylinder head can be ensured even with a water pump having a relatively low driving power. The longitudinal duct 7 cools the valve bushings 13 and 14 and, moreover, protects the oil present in the valve chamber 18 located thereabove from being heated up too highly. Furthermore, in cylinder head 1, the locations under high thermal load, especially the surroundings of the outlet ducts 12, the zone between the outlet duct 12 and the bore 17 for the spark plug, as well as the walls of the combustion chamber 4, are cooled by means of a defined cross flow through the connecting ducts 8, 9, and 10.

While I have shown and described only one embodiment in accordance with the present invention, it is understood that the same is not limited thereto but is susceptible to numerous changes and modifications as known to one having ordinary skill in the art, and I, therefore, do not wish to be limited to the details shown and described herein, but intend to cover all such modifications as are encompassed by the scope of the appended claims.

What is claimed is:

1. A cylinder head, producible by the pressure diecasting method, for liquid-cooled multicylinder internal combustion engines comprising:

series-arranged combustion chambers;

suspended inlet and outlet valves;

valve bushings disposed in at least one row for the suspended inlet and outlet valves;

water spaces which can be connected to a cylinder block, wherein the water spaces are disposed around the combustion chambers and are formed in a niche-like manner toward a dividing plane of the cylinder head to the cylinder block;

at least one longitudinal duct arranged in parallel to the series of combustion chambers and at a spacing from the dividing plane; and connecting ducts between the water spaces and the longitudinal duct, wherein the connecting ducts extend transversely to the series of combustion chambers, further comprising:

the longitudinal duct located, with respect to the dividing plane, beyond the combustion chambers as well as in parallel and in close adjacency to the row of valve bushings; and the connecting ducts arranged at an angle to the dividing plane and extended linearly from the water spaces to the longitudinal duct as one of bores and diecasting grooves.

2. The cylinder head according to claim 1, further comprising:

the longitudinal duct extends approximately centrally above the series of combustion chambers between the two rows of valve bushings for the inlet and outlet valves suspended in a V-shaped fashion, wherein the valve bushings are arranged V-shaped with respect to each other, bores for spark plugs disposed approximately in parallel beside the outlet ducts, terminating on the longitudinal side, and approximately in joint transverse planes with inlet ducts terminating on the other longitudinal side, wherein one connecting duct is arranged on both sides of each outlet duct approximately in parallel, transverse planes, and respectively one of these connecting ducts extends between an outlet duct and the bore for the spark plugs, and respectively one further connecting duct is arranged beside each inlet duct and approximately in a joint transverse plane with each outlet duct, and the connecting ducts extend from the longitudinal duct toward both sides under respectively an angle of about 30° to 60° obliquely to the dividing plane.

* * * * *